US007914092B2

(12) United States Patent
Harvey

(10) Patent No.: US 7,914,092 B2
(45) Date of Patent: Mar. 29, 2011

(54) DRESSER

(76) Inventor: Dennis N Harvey, Burlington, NC (US)

( * ) Notice: Subject to any disclaimer, the term of this patent is extended or adjusted under 35 U.S.C. 154(b) by 465 days.

(21) Appl. No.: 12/023,351

(22) Filed: Jan. 31, 2008

(65) Prior Publication Data

US 2009/0195128 A1 Aug. 6, 2009

(51) Int. Cl.
*A47B 88/00* (2006.01)

(52) U.S. Cl. ..... 312/322; 312/139.1

(58) Field of Classification Search ..... 312/196, 312/307, 322, 323, 324, 349, 350, 238, 138.1, 312/139.1, 139.2, 109
See application file for complete search history.

(56) References Cited

U.S. PATENT DOCUMENTS 1,175,887 A * 3/1916 Miller ..... 312/139.1
1,219,404 A * 3/1917 Smith ..... 312/139.1
1,678,453 A * 7/1928 Welch ..... 312/139.1
1,764,229 A 6/1930 Smith
2,206,347 A * 7/1940 Derman ..... 312/260
2,605,159 A 7/1952 Horn
D169,345 S 4/1953 Walent
2,703,267 A 3/1955 Purdy
2,941,659 A 6/1960 Thrower
3,198,594 A * 8/1965 Murray ..... 312/238
4,288,136 A * 9/1981 Le Mer ..... 312/297
4,818,044 A * 4/1989 Dobry ..... 312/257.1
5,083,847 A * 1/1992 Peters ..... 312/322
5,148,283 A 9/1992 Taddeo
6,231,137 B1 * 5/2001 Lye et al. ..... 312/140.4
6,908,000 B2 * 6/2005 Craft et al. ..... 211/144
6,931,676 B1 8/2005 Henley, Jr.

* cited by examiner

*Primary Examiner* — Janet M Wilkens

(57) ABSTRACT

A dresser featuring a center storage piece having a first set of drawers on one side and a second set of drawers on the other side, a set of shelves and a first concealing device and a second concealing device the first concealing device featuring a first track for a first door to slide open and shut, wherein the first track has a major bend and a minor bend, and wherein the first door features a couple of guide studs located on an upper edge of the first door and a couple of guide studs located on a bottom edge of the first door.

3 Claims, 11 Drawing Sheets

DRESSER

FIELD OF THE INVENTION

The present invention is directed to a dresser that includes a first set of drawers, a second set of drawers, a set of shelves, a first concealing device, and a second concealing device that enables a person to conceal stored clothing, shoes, and electronic equipment while simultaneously being able to open the dresser for full access.

BACKGROUND OF THE INVENTION

Persons with clothing often wish to store their clothing in a concealed manner such as a storage unit. Persons also may wish to have a storage unit that fits within a specific corner of a room. Additionally, a person may wish to have a storage unit that will store entertainment equipment. One solution is to have a first storage unit that stores the clothing and a second storage unit that stores the entertainment equipment. However, a room in a house may be too small to have more than one unit to store items. Additionally, the storage unit will not fit within a corner of a room. Furthermore, the device used for opening and closing the dresser does not allow for full access to the stored items.

Therefore, there is a need for an improved dresser, where a person may conceal stored items within the dresser and gain full access to the items using the device for opening and closing the dresser.

DESCRIPTION OF PREFERRED EMBODIMENTS

Figure 1:
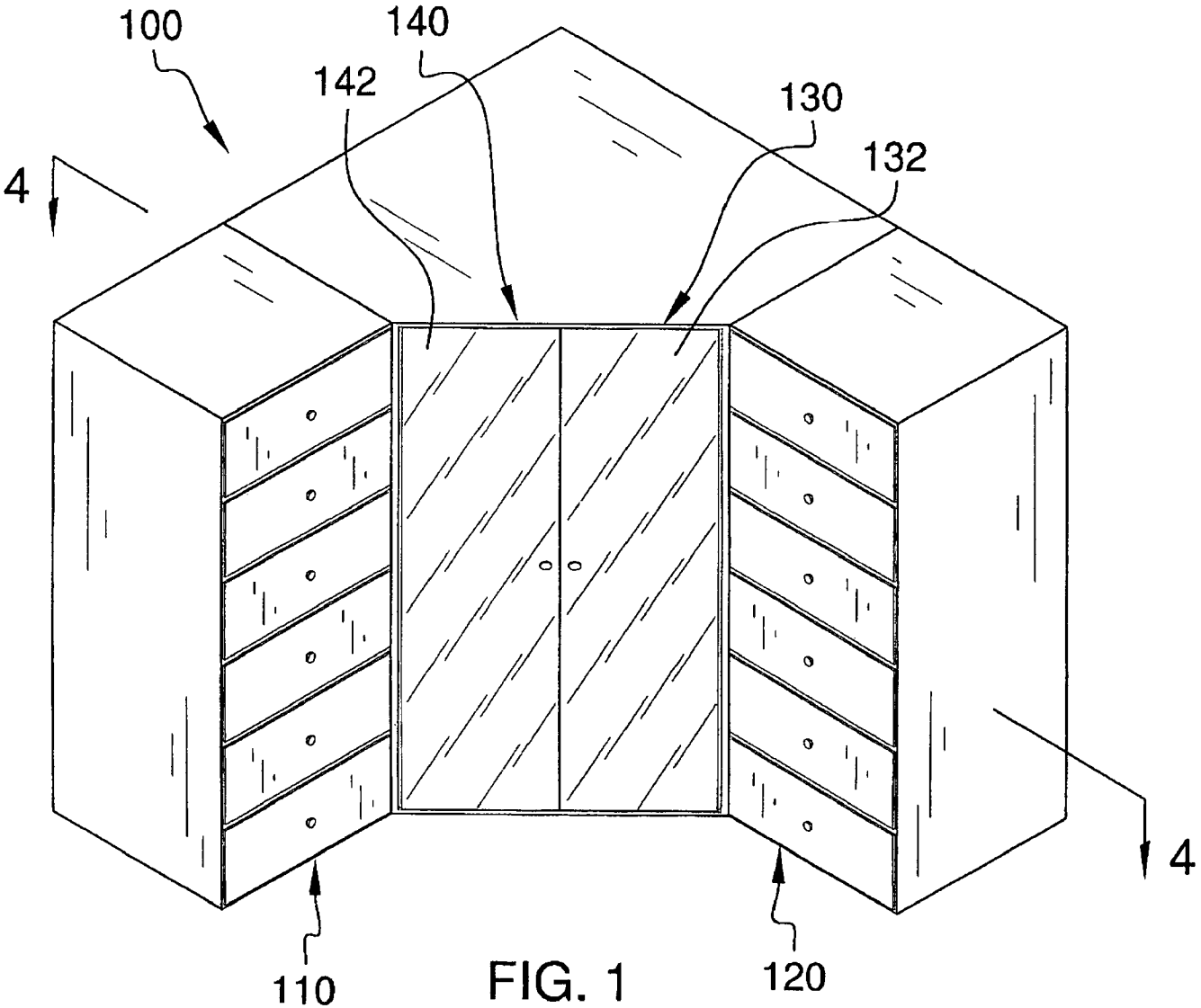
FIG. 1 is an illustration of a dresser according to the invention including a first set of drawers, a second set of drawers, a first concealing device, and a second concealing device.

Referring now to FIG. 1, dresser 100 comprises first set of drawers 110, second set of drawers 120, first concealing device 130, and second concealing device 140. In the illustrated embodiment of FIG. 1, first concealing device 130 comprises a first door 132. In the illustrated embodiment of FIG. 1, second concealing device 140 comprises second door 142. In the illustrated embodiment of FIG. 1, dresser 100 fits in a corner to provide maximum storage area with minimum area in a room being used.

In the illustrated embodiment of FIG. 1, first set of drawers 110 comprises a rigid material selected from the group consisting of metal, an engineering plastic, wood, or combinations thereof. In certain embodiments, first set of drawers 110 comprises one drawer. In other embodiments, first set of drawers 110 comprises at least one drawer. In the illustrated embodiment of FIG. 1, second set of drawers 120 comprises a rigid material selected from the group consisting of metal, an engineering plastic, wood, or combinations thereof. In certain embodiments, second set of drawers 120 comprises one drawer. In other embodiments, second set of drawers 120 comprises at least one drawer.

In the illustrated embodiment of FIG. 1, first door 132 comprises a rigid material selected from the group consisting of metal, an engineering plastic, wood, or combinations thereof. In certain embodiments, first door 132 comprises a height of about 58.5 inches. In certain embodiments, first door 132 comprises a width of about 16 inches. In certain embodiments, first door 132 comprises a mirror on the outside of first door 132. As used herein, the term "about" means plus or minus 10% of the referenced number.

In the illustrated embodiment of FIG. 1, second door 142 comprises a rigid material selected from the group consisting of metal, an engineering plastic, wood, or combinations thereof. In certain embodiments, second door 142 comprises a height of about 58.5 inches. In certain embodiments, second door 142 comprises a width of about 16 inches. In certain embodiments, second door 142 comprises a mirror on the outside of second door 142.

Figure 2:
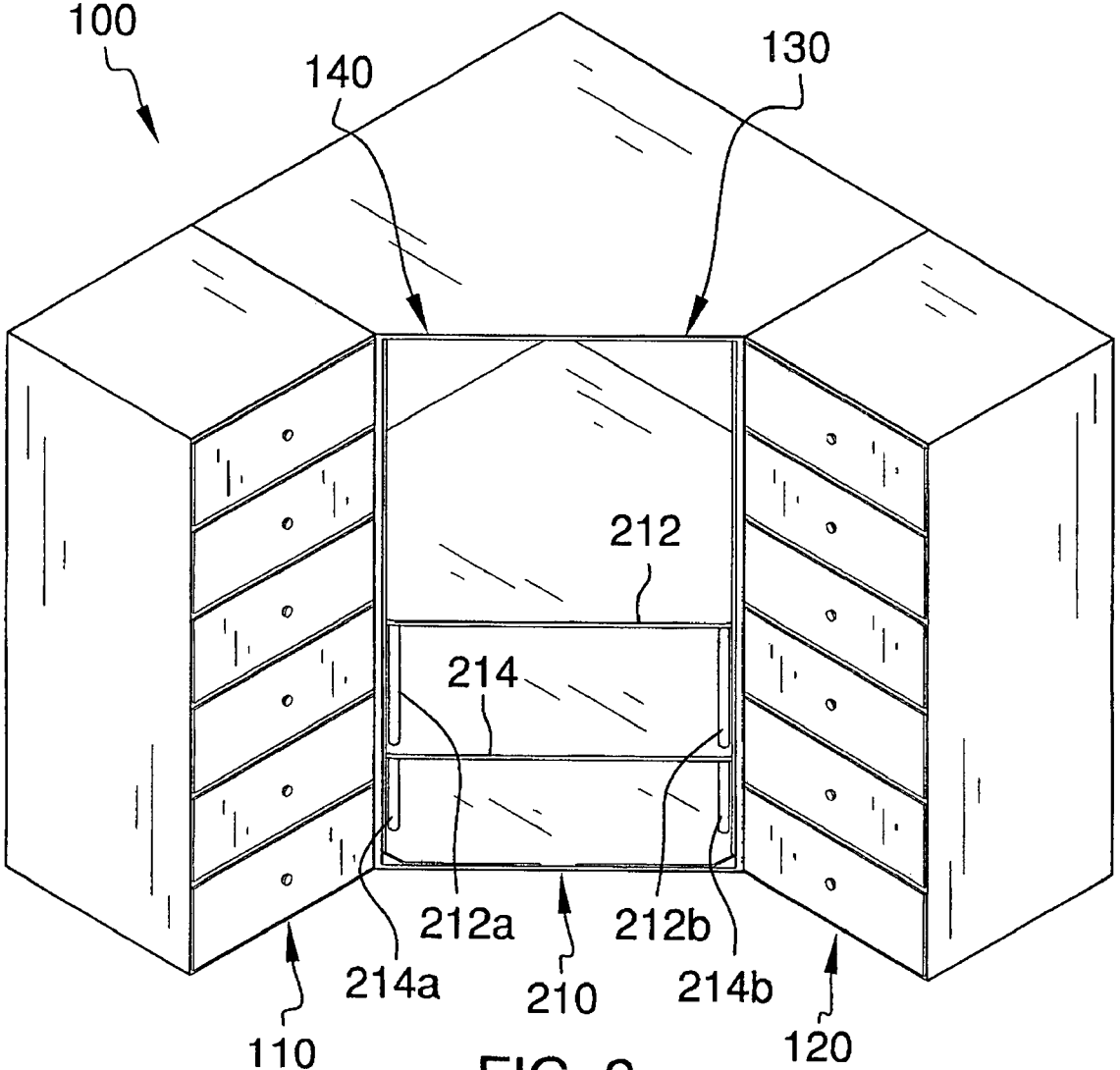
FIG. 2 is an illustration of a dresser according to the invention with a first concealing device and a second concealing in open position including a first set of drawers, a second set of drawers, and a set of shelves.

Referring now to FIG. 2, dresser 100 comprises first set of drawers 110, second set of drawers 120, first concealing device 130, second concealing device 140, and a set of shelves 210. In the illustrated embodiment of FIG. 2, set of shelves 210 comprises a first shelf 212 and a second shelf 214. In the illustrated embodiment of FIG. 2, first shelf 212 comprises first support leg 212*a* and second support leg 212*b*. In the illustrated embodiment of FIG. 2, second shelf 214 comprises first support leg 214*a* and second support leg 214*b*.

In the illustrated embodiment of FIG. 2, first door 132 and second door 134 are in an open position and hidden within dresser 100 providing access to set of shelves 210.

In the illustrated embodiment of FIG. 2, first shelf 212 comprises a rigid material selected from the group consisting of metal, an engineering plastic, wood, or combinations thereof.

In the illustrated embodiment of FIG. 2, second shelf 214 comprises a rigid material selected from the group consisting of metal, an engineering plastic, wood, or combinations thereof.

In the illustrated embodiment of FIG. 2, first support leg 212*a* comprises a rigid material selected from the group consisting of metal, an engineering plastic, wood, or combinations thereof. In certain embodiments, first support leg 212*a* comprises a tubular member having a length (i.e., height) between about 10 inches and about 15 inches. In certain embodiments, first support leg 212*a* comprises a tubular member having an outside diameter between about 0.5 inch and about 1 inch. In certain embodiments, first support leg 212*a* comprises a solid member having circular cross-section.

In the illustrated embodiment of FIG. 2, second support leg 212*b* comprises a rigid material selected from the group consisting of metal, an engineering plastic, wood, or combinations thereof. In certain embodiments, second support leg 212*b* comprises a tubular member having a length between about 10 inches and about 15 inches. In certain embodiments, second support leg 212*b* comprises a tubular member having an outside diameter between about 0.5 inch and about 1 inch. In certain embodiments, second support leg 212*b* comprises a solid member having circular cross-section.

In the illustrated embodiment of FIG. 2, first support leg 214*a* comprises a rigid material selected from the group consisting of metal, an engineering plastic, wood, or combinations thereof. In certain embodiments, first support leg 214*a* comprises a tubular member having a length between about 10 inches and about 15 inches. In certain embodiments, first support leg 214*a* comprises a tubular member having an outside diameter between about 0.5 inch and about 1 inch. In certain embodiments, first support leg 214*a* comprises a solid member having circular cross-section.

In the illustrated embodiment of FIG. 2, second support leg 214*b* comprises a rigid material selected from the group consisting of metal, an engineering plastic, wood, or combinations thereof. In certain embodiments, second support leg 214*b* comprises a tubular member having a length between about 10 inches and about 15 inches. In certain embodiments, second support leg 214*b* comprises a tubular member having an outside diameter between about 0.5 inch and about 1 inch. In certain embodiments, second support leg 214*b* comprises a solid member having circular cross-section.

In some embodiments, furniture buttons (or tacks) are pinned on the bottom side of the dresser to provide a slight lift of the dresser off the ground. For example, a furniture button may be pinned at each corner on the bottom side of the dresser.

Figure 3A:
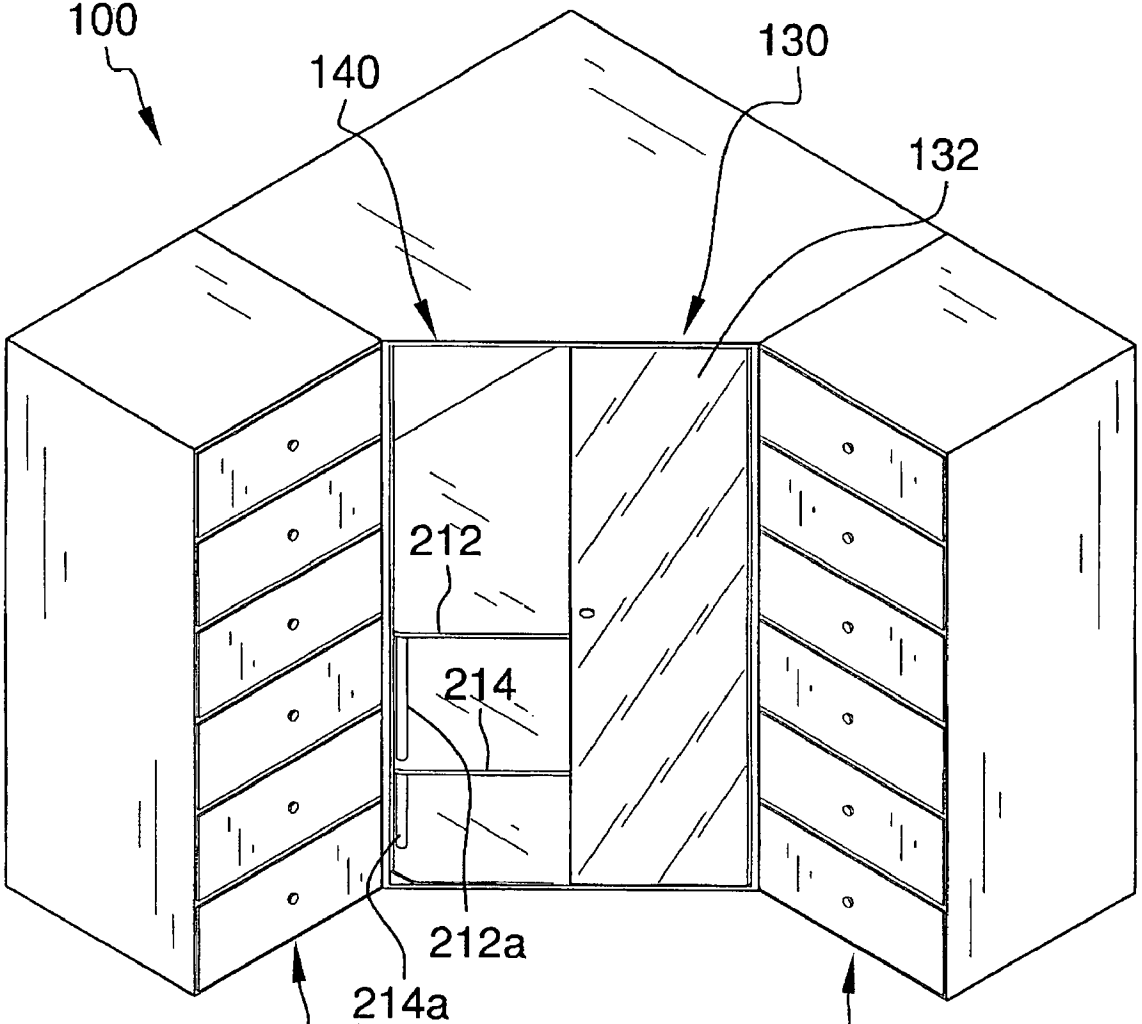
FIG. 3A is an illustration of a dresser according to the invention with the second concealing device in open position.
Figure 3B:
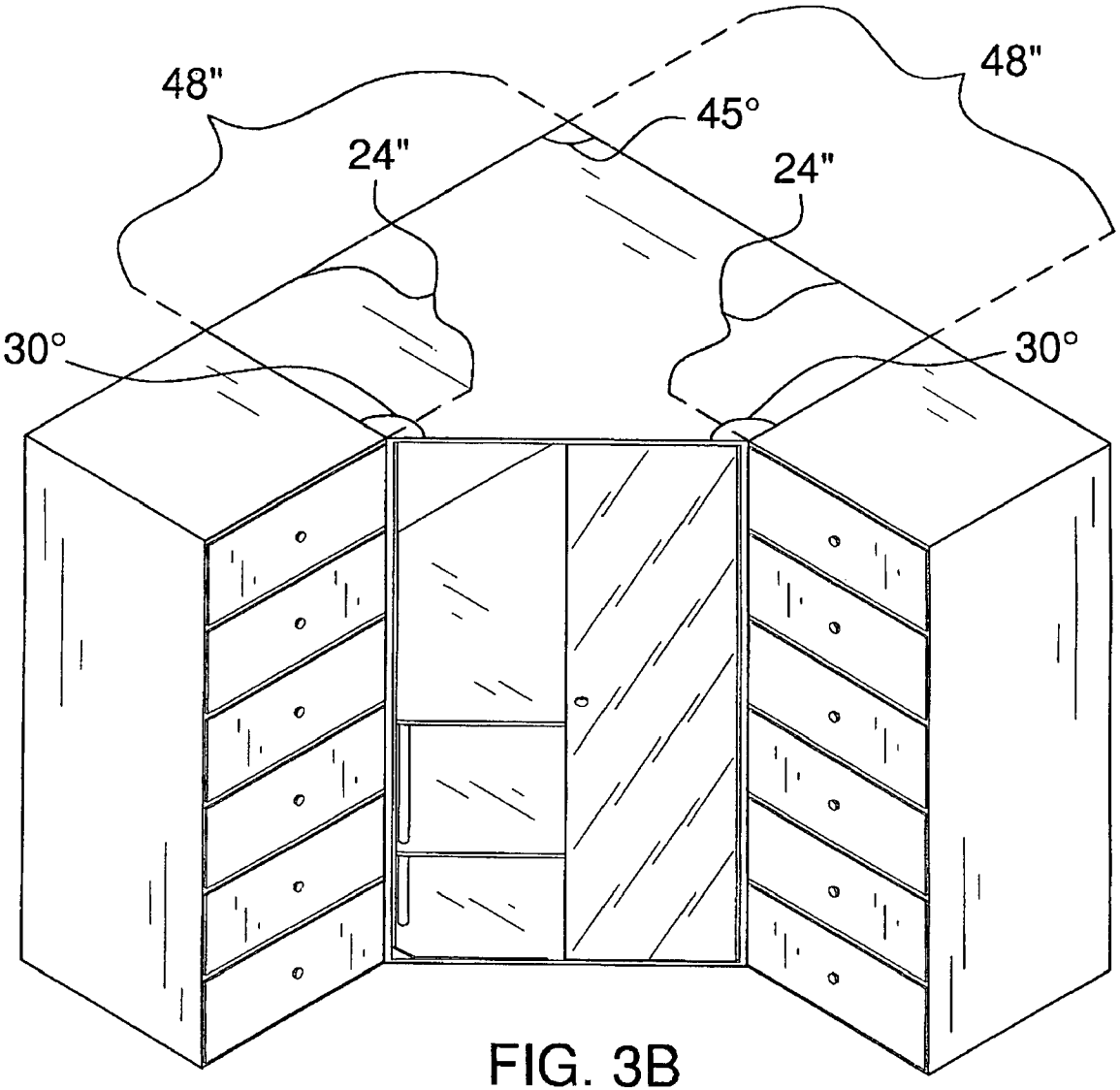
FIG. 3B shows the particular dimensions of the novel dresser.

Referring now to FIG. 3, dresser 100 comprises first set of drawers 110, second set of drawers 120, first concealing device 130, second concealing device 140, and a set of shelves 210. In the illustrated embodiment of FIG. 3, set of shelves 210 comprises a first shelf 212 and a second shelf 214. In the illustrated embodiment of FIG. 3, first shelf 212 comprises first support leg 212*a*. In the illustrated embodiment of FIG. 3, second shelf 214 comprises first support leg 214*a*. In the illustrated embodiment of FIG. 3, first door 132 is closed and second door 142 is open.

Figure 4A:
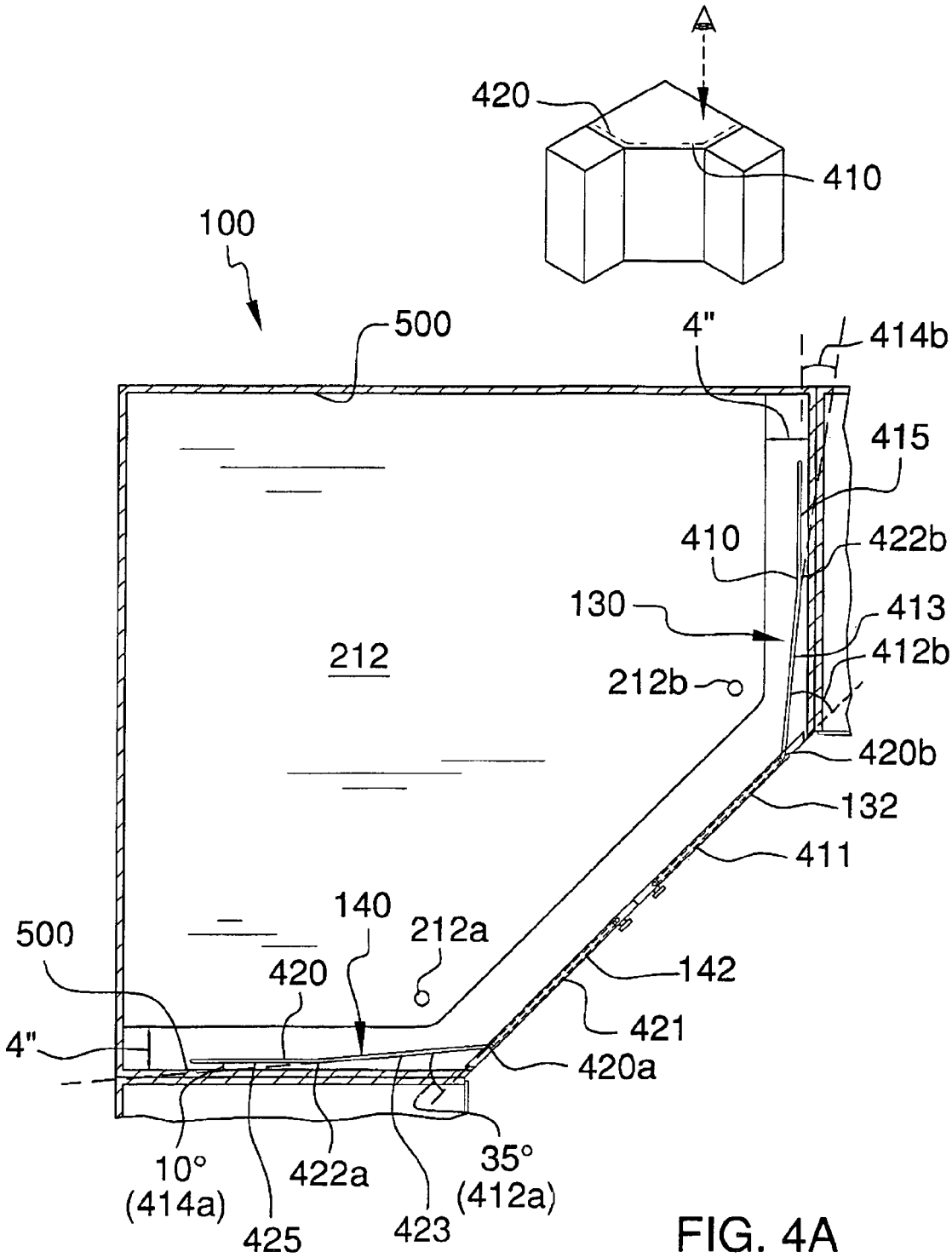
FIG. 4A is a top view illustration (looking from the top surface) of a dresser according to the invention including a set of shelves, a first support leg, a second support, a first concealing device, and a second concealing device. The ceiling of the center storage piece is on the underside of the top surface.
Figure 4B:
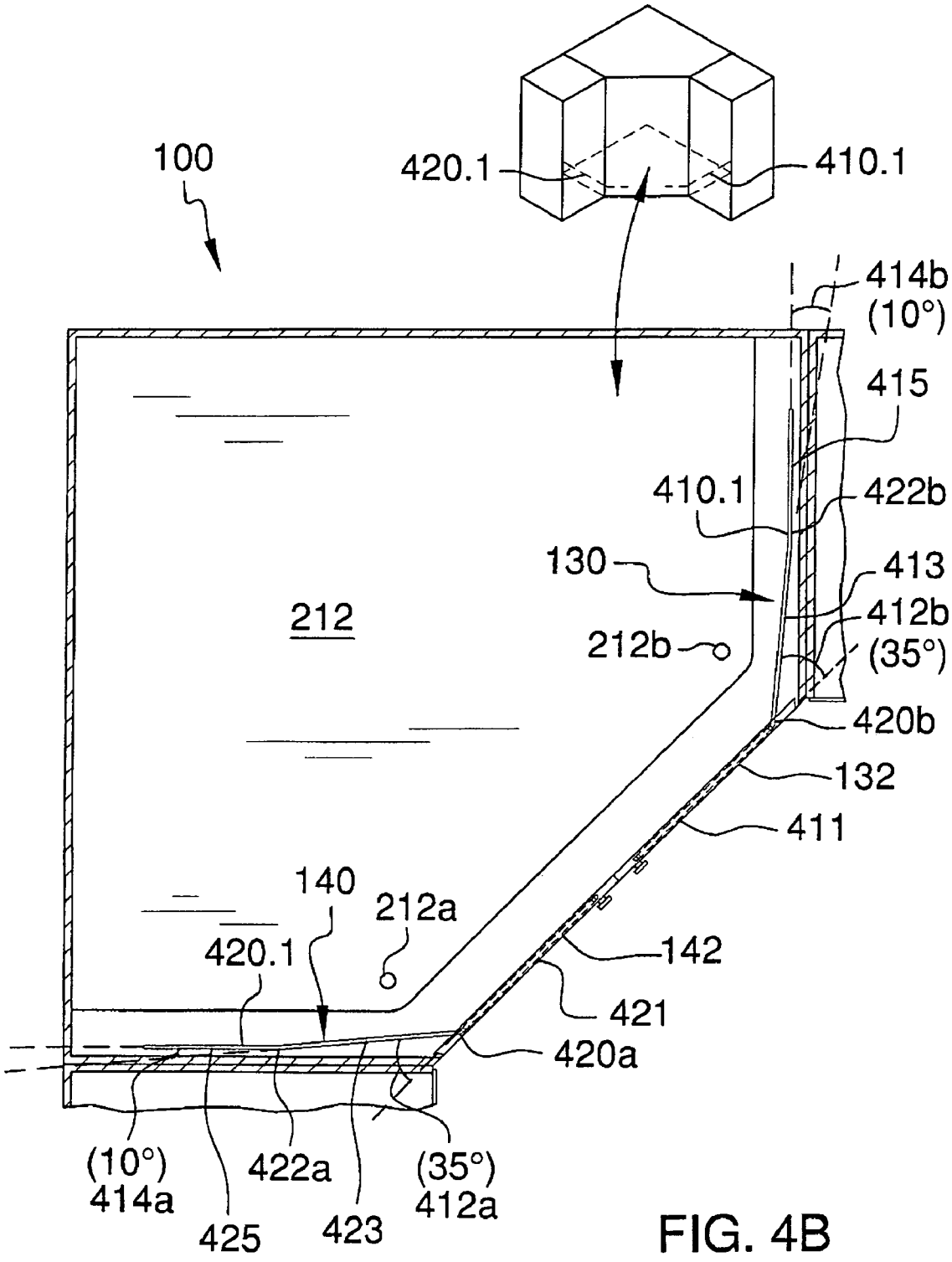
FIG. 4B is again a top view looking pass the top tracks and the shelves, and seeing the bottom tracks attached to the floor of the center storage piece.

Referring to FIG. 4, a top view of dresser 100 is shown comprising first concealing device 130, second concealing device 140, first door 132, second door 142, first shelf 212, first support leg 212*a*, and second support leg 212*b*. In the illustrated embodiment of FIG. 4, first concealing device 130 comprises first track 410. In the illustrated embodiment of FIG. 4, second concealing device 140 comprises second track 420. In the illustrated embodiment of FIG. 4, first track 410 and second track 420 comprise a major bend 420*a*/420*b* and a minor bend 422*a*/422*b*. The major bend 420*a*/420*b* has an angle 412*a*/412*b* of about 35 degrees (see FIG. 4B). The minor bend 422*a*/422*b* has an angle 414*a*/414*b* of about 10 degrees (see FIG. 4B). As used herein, the term "about" means plus or minus ten percent from the reference number, e.g., "about" 10 degrees means 9 to 11 degrees.

In the illustrated embodiment of FIG. 4, first door 132 and second door 142 are in a closed position. When a user desires to have access to stored items on set of shelves 210 (see FIGS. 2 and 3), the user will push first door 132 and/or second door 142 into dresser 100 along first track 410 and second track, respectively.

In the illustrated embodiment of FIG. 4, first track 410 comprises a standard slot track known to one skilled in the art. In certain embodiments, first track 410 comprises a set of rollers known to one skilled in the art that allows first door 132 to slide on first track 410. In the illustrated embodiment of FIG. 4, second track 420 comprises a standard slot track known to one skilled in the art. In certain embodiments, second track 420 comprises a set of rollers known to one skilled in the art that allows second door 142 to slide on second track 420.

Figure 5A:
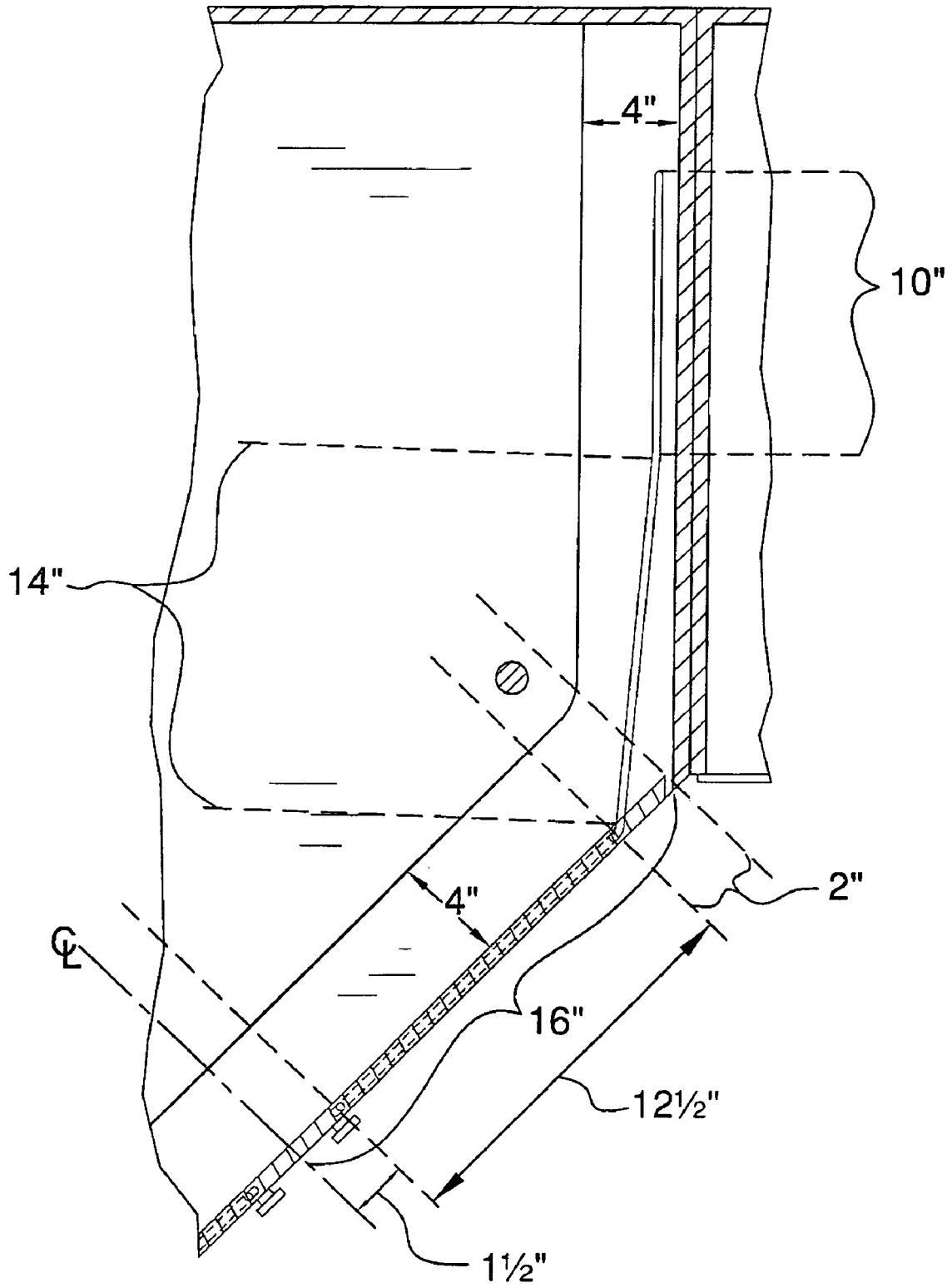
FIG. 5A is a top view of a dresser according to the invention with a first concealing device in closed position.
Figure 5B:
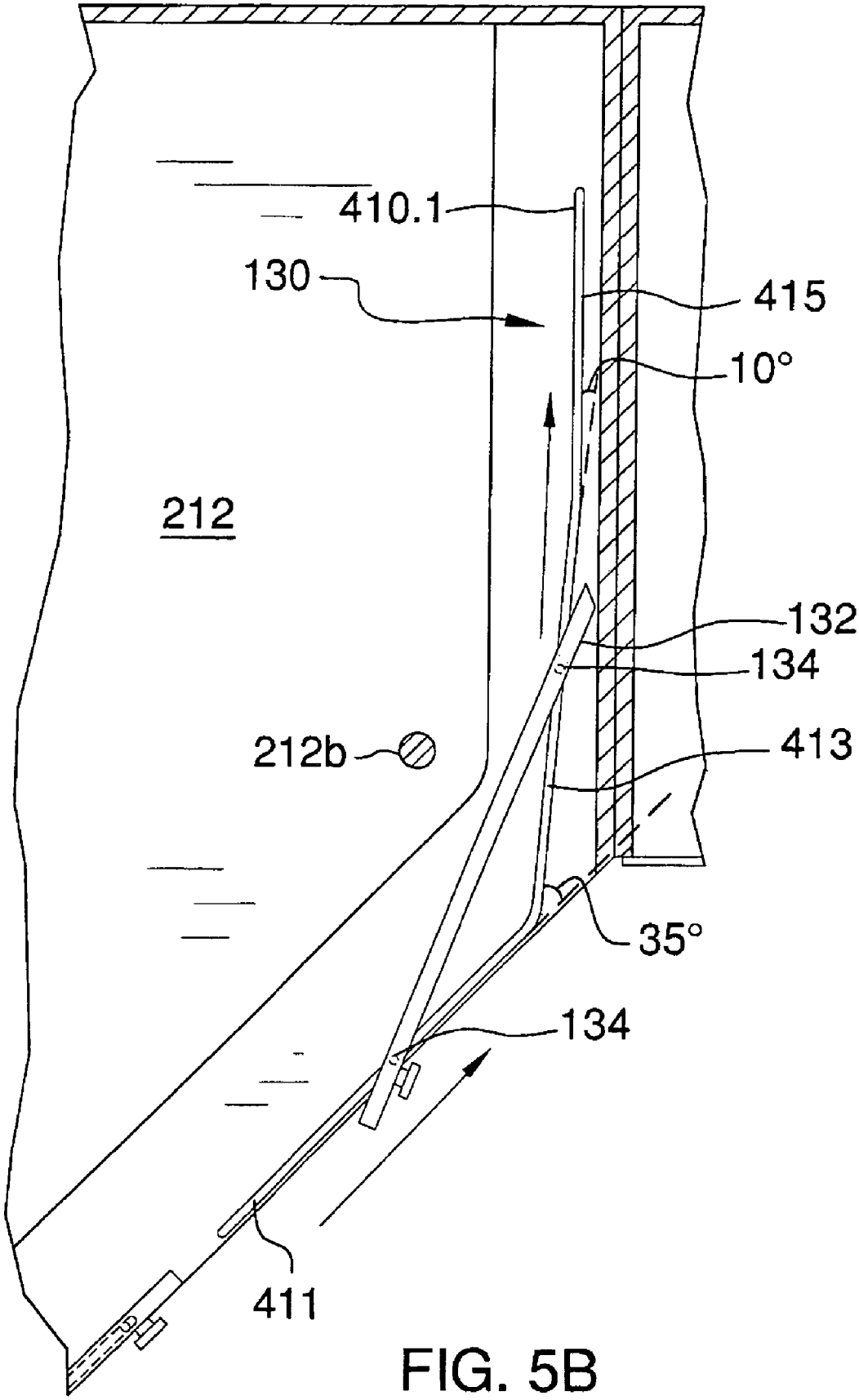
FIG. 5B is a top view of a dresser according to the invention with a first concealing device in a semi-open position.

Referring to FIG. 5, a top view of one side of dresser 100 is shown comprising first concealing device 130, first door 132, first shelf 212, second support leg 212*b*, and first track 410. In the illustrated embodiment of FIG. 5, first door 132 is shown in a half open position. In the illustrated embodiment of FIG. 5, first door 132 is pushed into dresser 100 on first track 410. First door 132 is hid within dresser 100 when first door 132 is in a full open position.

Figure 7:
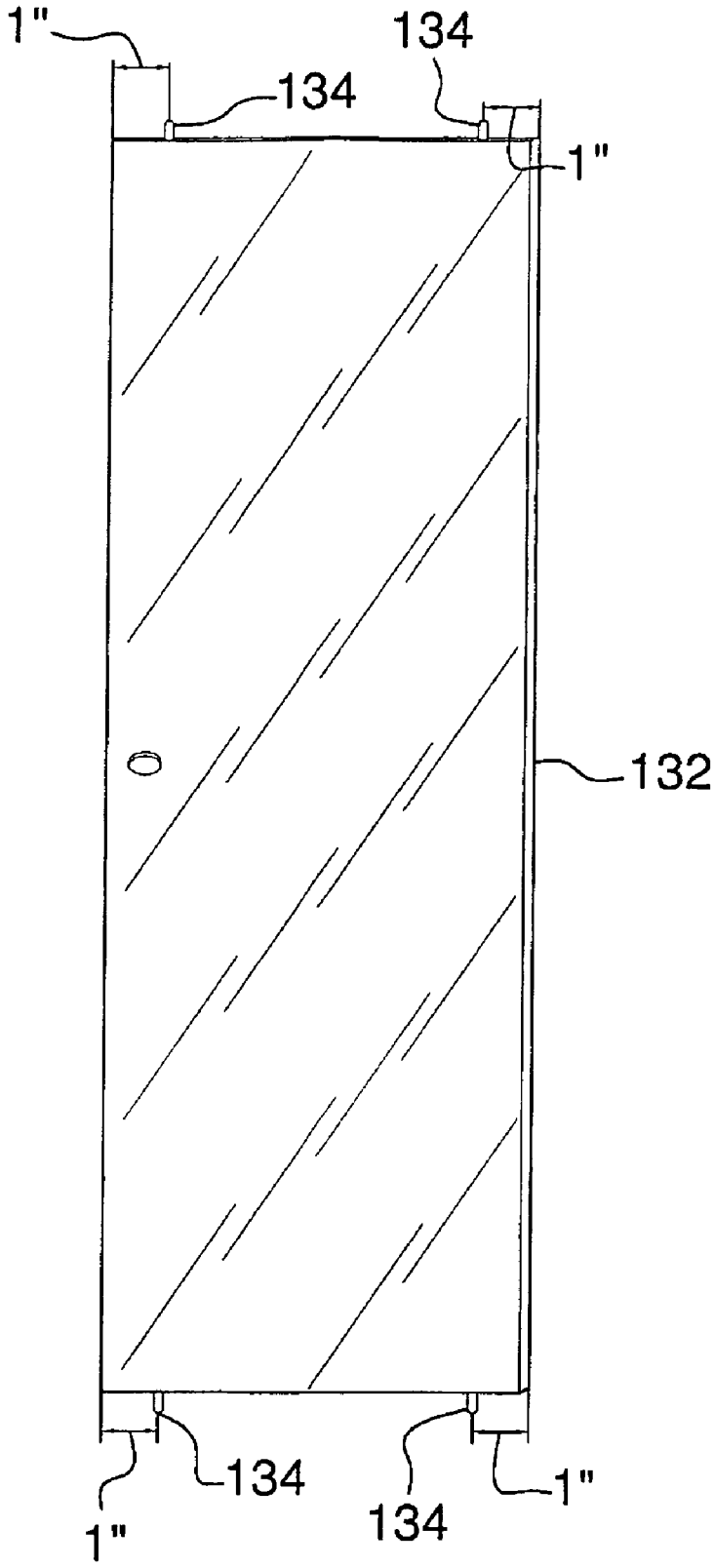
FIG. 7 shows a door with a couple of studs attached near the top and bottom edges of a door.
Figure 8:
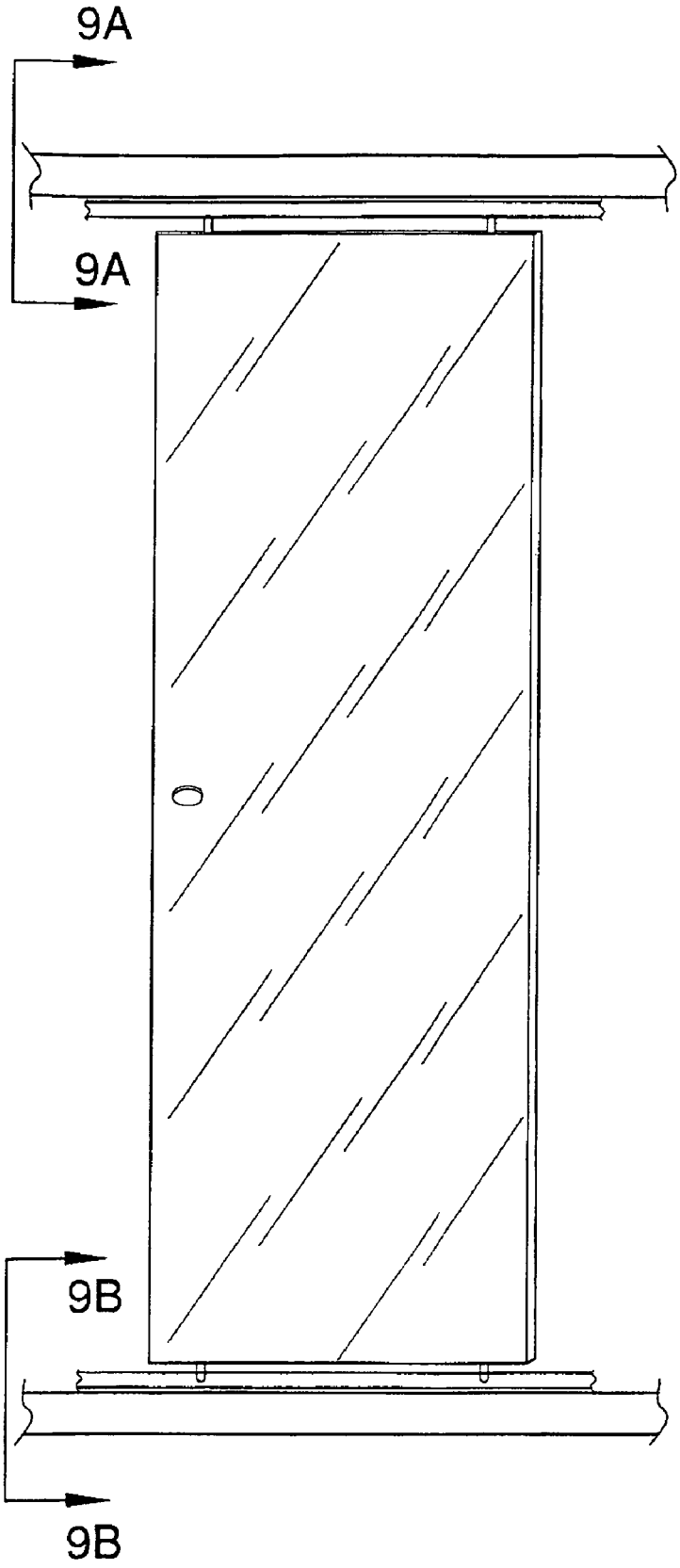
FIG. 8 shows a door slide-ably secured to a top track and a bottom track, which are attached to the ceiling and floor of the center storage piece, respectively.
Figure 9A:
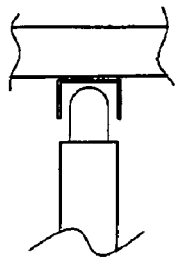
FIGS. 9A and 9B show a cross sectional view of the door being slide-ably secured to the top track and bottom track.
Figure 9B:
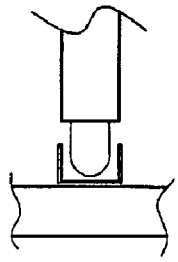

In some embodiments, the first concealing device 130 comprises a first top track 410 and a first bottom track 410.1 for a first door 132 to be sandwiched there between, wherein the first door can slide open and shut. The first top track 410 and the first bottom track 410.1 each comprise a first portion 411 being about 12.5 inches, a second portion 413 being about 12 inches and a third portion 415 being about 12 inches. In some embodiments, the second portion 413 bends away from the first portion 411 by about 35 degrees (major bend) towards the back of the dresser and the third portion 415 bends away from the second portion 413 by about 10 degrees (minor bend) towards the back of the dresser. The first door 132 comprises a couple of guide studs 134 located on an upper edge of the first door and a couple of guide studs 134 located on a bottom edge of the first door. The guide studs 134 resides within sidewalls of the first top track 410 first bottom track and glides back and forth therein along with the first door 132. The studs are positioned about 1 inch from each edge of the first door 132 (see FIG. 7). The first top track is attached to the ceiling of the center storage piece 100, and the first bottom track 410.1 is attached to the floor of the center storage piece 100, in a manner such that when viewed from the top of the center storage piece 100, the first top track 410 super imposes exactly on the first bottom track 410.1.

The left top track 420 has the same dimensions as that of the right top track 410, except that they are mirror images of each other. The left bottom track 420.1 has the same dimensions as that of the right bottom track 410.1, except that they are mirror images of each other.

In some embodiments, the second concealing device 140 comprises a second track 420 for a second door 142 to slide open and shut. The second track 420 comprises a first portion 421 being about 12.5 inches, a second portion 423 being about 12 inches and a third portion 425 being about 12 inches. In some embodiments, the second portion 423 bends away from the first portion 421 by about 35 degrees (major bend) towards the back of the dresser and the third portion 425 bends away from the second portion 423 by about 10 degrees (minor bend) towards the back of the dresser. The second door 142 comprises a couple of guide studs 134 located on an upper edge of the first door and a couple of guide studs 134 located on a bottom edge of the first door. The guide studs 134 resides within the sidewalls of the second track 420 and glides back and forth therein along with the second door 142. The studs are positioned about 1 inch from each edge of the second door 142 (see FIG. 7). The second top track 420 is attached to the ceiling of the center storage piece 100, and the second bottom track 420.1 is attached to the floor of the center storage piece 100, in a manner such that when viewed from the top of the center storage piece 100, the second top track 420 super imposes exactly on the second bottom track 420.1.

Figure 6:
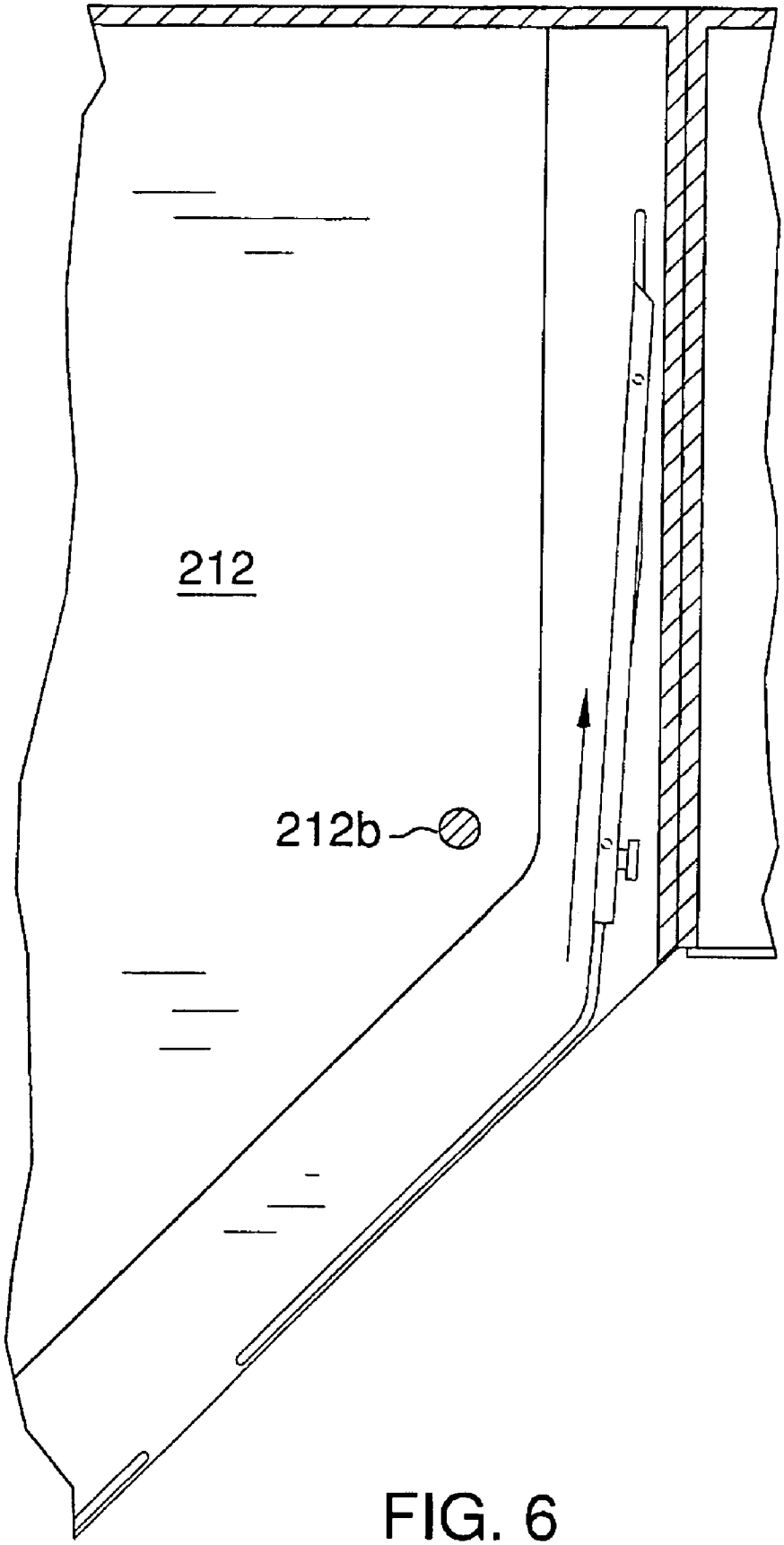
FIG. 6 is a top view of a dresser according to the invention with a first concealing device in a completely open position (door slide all the way back).

Referring to FIG. 6, a top view of one side of dresser 100 is shown comprising first concealing device 130, first door 132, first shelf 212, second support leg 212*b*, and first track 410.

The outer edge shelves 212/214 are set back by about 4 inches from the sidewalls 500 and doors 132/142 of the center storage piece to allow enough room for the doors 132/142 to glide back and forth (see FIGS. 4-6).

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. For example, a bigger or smaller novel dresser may be constructed using the proportionate dimensions (e.g., ratios) of the dimensions set forth herein. Therefore, the scope of the invention is only to be limited by the following claims.

What is claimed is:

1. A dresser comprising a center storage piece having a first set of drawers on a first side and a second set of drawers on a second side, the center storage piece comprises a set of shelves and a first concealing device and a second concealing device, wherein the first concealing device comprises a first top track and a first bottom track for a first door to be slide-ably sandwiched there between, the first top track is attached to a ceiling of the center storage piece and the first bottom track is attached to a floor of the center storage piece, the first top track and the first bottom track are identical and each comprise a first portion being about 12.5 inches, a second portion being about 12 inches and a third portion being about 12 inches, the second portion bends away from the first portion by about 35 degrees towards a back of the dresser creating a first major bend and the third portion bends away from the second portion by about 10 degrees towards the back of the dresser creating a first minor bend, a first door comprises a couple of guide studs located near upper edges of the first door that engages with the first top track and a couple of guide studs located near bottom edges of the first door for engaging with the first bottom track, wherein the first top track is a single track comprising both a first minor bend and a first major bend such that the guide stud engaged in the first top track can slide within the first top track through both the first minor bend and the first major bend, wherein the first bottom track is a single track comprising both a first minor bend and a first major bend such that the guide stud engaged in the first bottom track can slide within the first bottom track through both the first minor bend and the first major bend;

wherein the second concealing device comprises a second top track and a second bottom track for a second door to be slide-ably sandwiched there between, the second top track is attached to the ceiling of the center storage piece and the second bottom track is attached to the floor of the center storage piece, the second top track and the second bottom track are identical and each comprise a first portion being about 12.5 inches, a second portion being about 12 inches and a third portion being about 12 inches, the second portion bends away from the first portion by about 35 degrees towards the back of the dresser creating a second major bend and the third portion bends away from the second portion by about 10 degrees towards the back of the dresser creating a second minor bend, a second door comprises a couple of guide studs located near an upper edges of the second door that engages with the second top track and a couple of guide studs located near bottom edges of the second door for engaging with the second bottom track, wherein the second top track is a single track comprising both a second minor bend and a second major bend such that the guided stud engaged in the second top track can slide within the second top track through both the second minor bend and the second major bend, wherein the second bottom track is a single track comprising both a second minor bend and a second major bend such that the guide stud engaged in the second bottom track can slide within the second bottom track through both the second minor bend and the second major bend.

2. The dresser of claim 1, wherein the set of shelves further comprises at least a first shelf and a second shelf.

3. The dresser of claim 2, wherein the first shelf and the second shelf further comprise a first support leg and a second support leg that are parallel to each other.

* * * * *